US006578844B2

(12) United States Patent
Acquaviva et al.

(10) Patent No.: US 6,578,844 B2
(45) Date of Patent: Jun. 17, 2003

(54) SHEET FEEDER

(75) Inventors: Thomas Acquaviva, Pennfield, NY (US); Vittorio Castelli, Yorktown Heights, NY (US); Joannes deJong, Suffern, NY (US)

(73) Assignee: Xerox Corporation, Stamford, CT (US)

( * ) Notice: Subject to any disclaimer, the term of this patent is extended or adjusted under 35 U.S.C. 154(b) by 60 days.

(21) Appl. No.: 09/832,062

(22) Filed: Apr. 10, 2001

(65) Prior Publication Data

US 2002/0145249 A1 Oct. 10, 2002

(51) Int. Cl.[7] ..... B65H 7/02; B65H 9/20
(52) U.S. Cl. ..... 271/228
(58) Field of Search ..... 271/228, 227

(56) References Cited

U.S. PATENT DOCUMENTS

| | | | | |
|---|---|---|---|---|
| 4,988,087 A | | 1/1991 | Sardano et al. | 271/314 |
| 5,013,026 A | | 5/1991 | Howell | 271/187 |
| 5,014,977 A | | 5/1991 | Moore et al. | 271/221 |
| 5,040,783 A | | 8/1991 | Ruehl | 271/300 |
| 5,058,880 A | | 10/1991 | McGraw et al. | 271/315 |
| 5,065,996 A | | 11/1991 | McGraw et al. | 271/176 |
| 5,065,998 A | | 11/1991 | Salomon | 271/251 |
| 5,114,135 A | | 5/1992 | Evangelista et al. | 271/187 |
| 5,120,047 A | | 6/1992 | Mandel et al. | 271/220 |
| 5,135,115 A | | 8/1992 | Miller et al. | 209/564 |
| 5,145,167 A | | 9/1992 | McGraw et al. | 271/186 |
| 5,169,140 A | * | 12/1992 | Wenthe, Jr. | 271/228 |
| 5,178,379 A | | 1/1993 | Edwards et al. | 271/189 |
| 5,193,799 A | | 3/1993 | Scheufler et al. | 271/213 |
| 5,194,558 A | | 3/1993 | Carlston et al. | 528/60 |
| 5,199,703 A | | 4/1993 | Hess | 271/314 |
| 5,201,515 A | | 4/1993 | Funk | 271/224 |
| 5,201,517 A | | 4/1993 | Stemmle | 271/291 |
| 5,215,298 A | | 6/1993 | Stemmle et al. | 271/65 |
| 5,236,188 A | | 8/1993 | Breton et al. | 271/187 |
| 5,244,200 A | | 9/1993 | Manzke | 271/198 |
| 5,249,791 A | | 10/1993 | Belanger et al. | 271/182 |
| 5,249,793 A | | 10/1993 | Scheufler | 271/220 |
| 5,261,655 A | | 11/1993 | Keller et al. | 271/187 |
| 5,265,731 A | | 11/1993 | Van de Ven | 209/552 |
| 5,284,338 A | | 2/1994 | Allmendinger et al. | 271/220 |
| 5,288,062 A | | 2/1994 | Rizzolo et al. | 270/53 |
| 5,294,107 A | | 3/1994 | Allmendinger et al. | 271/220 |
| 5,295,680 A | | 3/1994 | Nishiguchi | 271/185 |
| 5,513,839 A | | 5/1996 | Green | 270/53 |
| 5,639,078 A | | 6/1997 | Mandel et al. | 270/58.12 |
| 5,639,080 A | | 6/1997 | Evans | 270/58.28 |
| 5,683,078 A | | 11/1997 | Schieck | 271/250 |
| 5,697,608 A | | 12/1997 | Castelli et al. | 271/228 |
| 5,697,609 A | | 12/1997 | Williams et al. | 271/228 |
| 5,732,943 A | * | 3/1998 | Delfosse | 271/228 |
| 5,870,114 A | * | 2/1999 | Numata et al. | 347/16 |
| 5,887,996 A | | 3/1999 | Castelli et al. | 400/579 |
| 6,053,494 A | | 4/2000 | Baskette et al. | 271/251 |
| 6,056,288 A | | 5/2000 | Tsai et al. | 271/213 |
| 6,059,284 A | | 5/2000 | Wolf et al. | 271/227 |
| 6,276,586 B1 | * | 8/2001 | Yeo et al. | 226/17 |

FOREIGN PATENT DOCUMENTS

| | | | | |
|---|---|---|---|---|
| JP | 11255382 A | * | 9/1999 | B65H/9/20 |

* cited by examiner

*Primary Examiner*—Christopher P. Ellis
*Assistant Examiner*—Mark A. Deuble
(74) *Attorney, Agent, or Firm*—Perman & Green, LLP

(57) ABSTRACT

A sheet feeder is provided comprising at least two drives that drive a sheet of material along a paper path and at least two sensors that detect a lateral side of the sheet of material. A controller is connected to the two sensors and at least one of the drives. The controller varies the drive velocity of at least one of the drives to shift the lateral position of the sheet of material in a predetermined direction until one of the sensors detects the lateral side and then varies the velocity difference of the two drives to eliminate the skew of the sheet.

14 Claims, 6 Drawing Sheets

SHEET FEEDER

BACKGROUND OF THE INVENTION

1. Field of the Invention

The present invention relates to a sheet feeding system and, more particularly, to a sheet feeding system adapted to offset sheets of material for a sheet stacker.

2. Prior Art

Many different feeding devices are known in the sheet feeding art. For example, U.S. Pat. No. 5,639,080 discloses a system for handling purged sheets in the output of a printer which offsets print job sets relative to one another and also offsets purge sheets from regular job sheets with a laterally movable stacking tray. The mechanism associated with driving the laterally movable tray adds both cost and complexity to the sheet stacking device in order to provide offsetting capability. U.S. Pat. No. 5,887,996 discloses an apparatus and method for sheet registration using a single sensor that determines the position and skew of a sheet in a paper path. A pair of independently driven nips forward the sheet to a registration position in skew and at the proper time based on the output from the single sensor. Both U.S. Pat. Nos. 5,639,080 and 5,887,996 are herein incorporated by reference in their entirety. There is a desire to provide a sheet feeding system that provides capability to both deskew and offset sheets of material without the cost and complexity associated with a laterally movable tray being required in a sheet stacker.

SUMMARY OF THE INVENTION

In accordance with one embodiment of the present invention, a sheet feeder is provided comprising at least two drives that drive a sheet of material along a paper path and at least two sensors that detect a lateral side of the sheet of material. A controller is connected to the two sensors and at least one of the drives. The controller varies the drive velocity of at least one of the drives to shift the lateral position of the sheet of material in a predetermined direction until one of the sensors detects the lateral side.

In accordance with one method of the present invention, a sheet feeder is provided comprising a drive that drives a sheet of material along a paper path and at least three sensors proximate the drive. Two of the sensors detect a skew of the sheet of material, and at least one of the sensors detects the lateral offset of the sheet of material from the paper path. A controller is connected to the sensors and the drive.

In accordance with another embodiment of the present invention, a method of feeding sheets of material is provided comprising the steps of changing the skew of the sheet of material to a predetermined value and then detecting a lateral side of the sheet of material.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
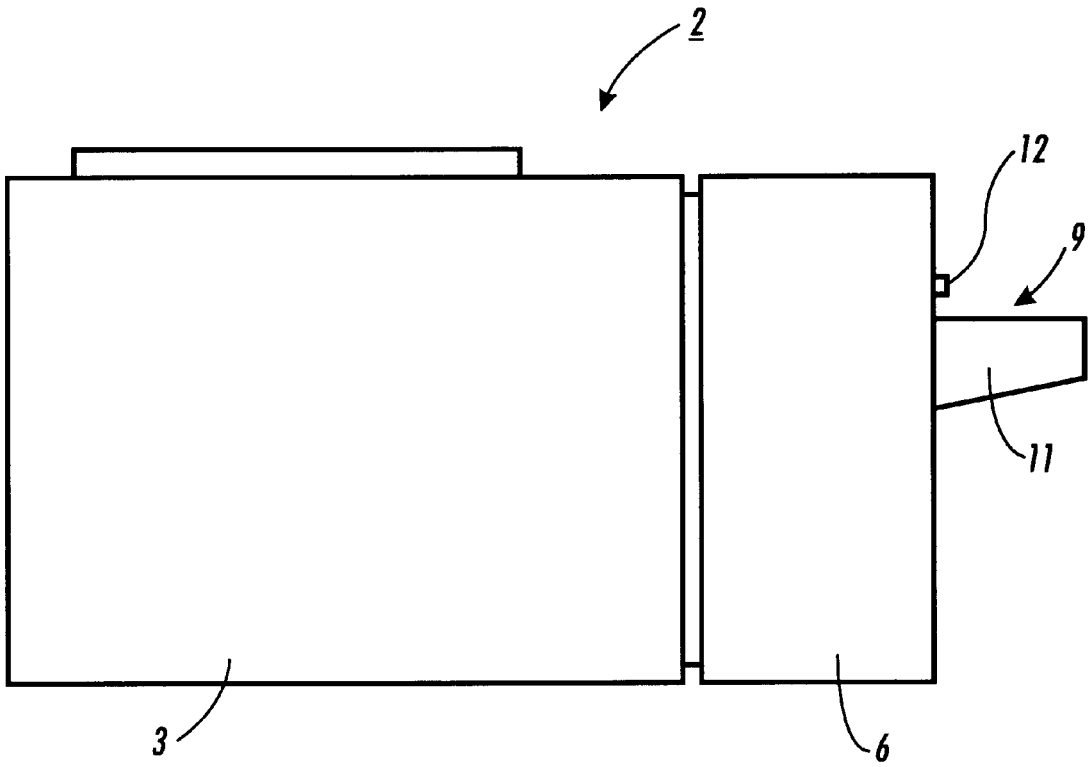
FIG. 1 is a schematic view of a document creating apparatus.

Referring to FIG. 1, there is shown, in schematic form, a view of a document creating apparatus 2 for creating documents in accordance with teachings of the present invention. Although the present invention will be described with reference to the single embodiment shown in the drawings, it should be understood that the present invention can be embodied in many alternate forms or embodiments. In addition, any suitable size, shape or type of elements or materials could be used. A copying or printing system of the type shown is preferably adapted to provide duplex or simplex stacked document sets from duplex or simplex collated document or print sets which result from either duplex or simplex original documents or output document computer files for print.

Document creating apparatus 2, in the embodiment shown, is a copier. However, in an alternate embodiment, the apparatus could be a printer or any other suitable type of document creating apparatus. Document creating apparatus 2 generally comprises a xerographic processing or printing section 3, a finishing section 6 and an output section 9. Printing section 3 can be an electrostatographic printing system such as made by Xerox Corporation or alternately other xerographic or other type of printing apparatus. Printing section 3 incorporates an image transfer system and a transport system for transporting sheets of material. Finishing section 6 may typically incorporate a hole punch, a stacker, a stapler, or any other suitable type of feature known in the art. Output section 9 incorporates a tray 11 or a bin sorter that accepts and stacks documents or document sets output from finishing section 6 at output zone 12. Documents are printed or copied in printing section 3 and output from printing section 3 to finishing section 6. Documents can be sorted, stacked and bound at finishing section 6. Document sets can be output from finishing section 6 at output zone 12.

Figure 2:
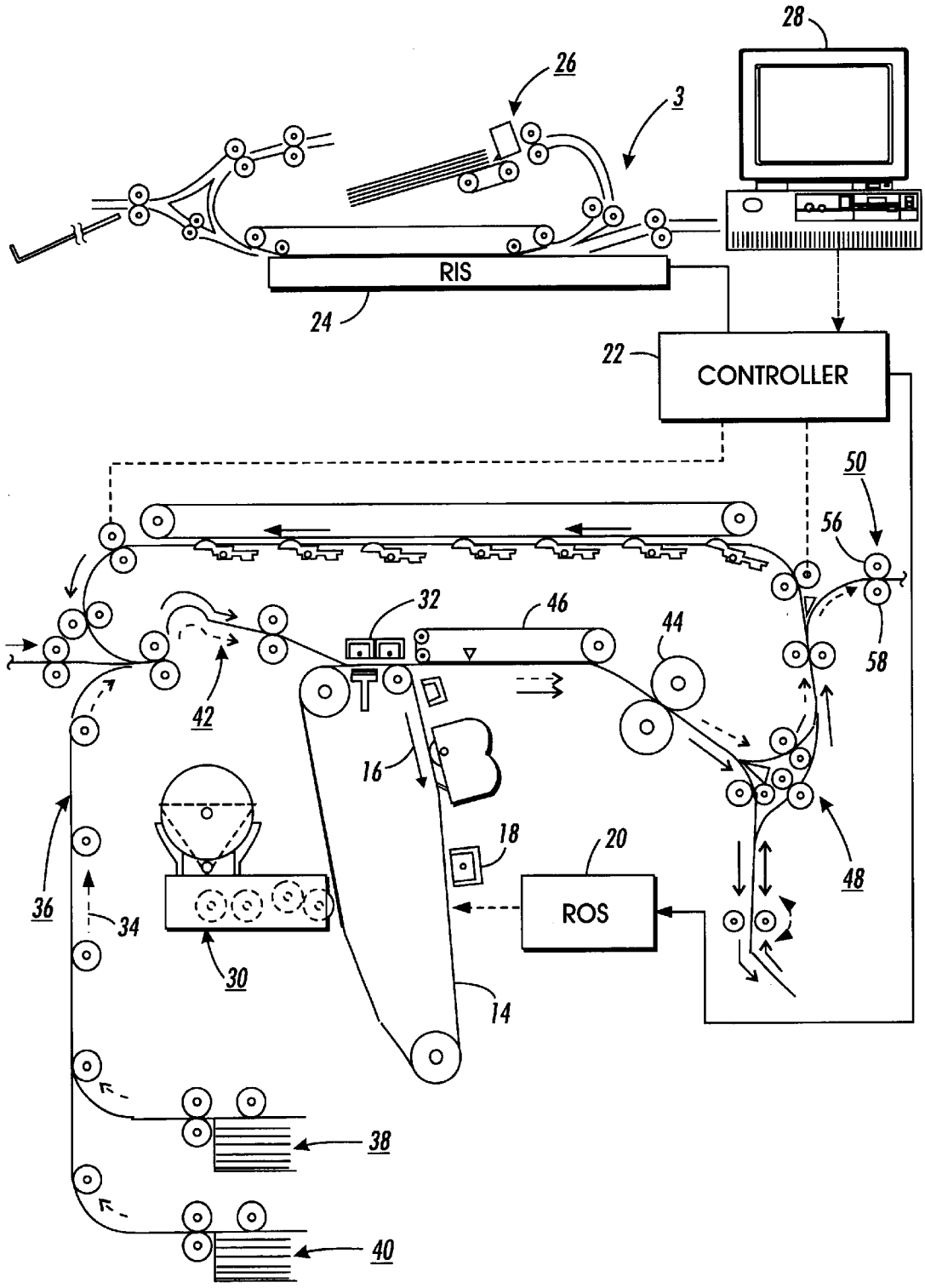
FIG. 2 is a schematic elevation section view of a xerographic processing or printing section or engine.

Referring now also to FIG. 2, there is shown is a schematic elevation view of one embodiment of the xerographic processing or printing section 3. The printing section 3 has a photoconductive belt 14 that advances in the direction of arrow 16. Photoconductive belt 14 passes through charging station 18 and exposure station 20 which is typically a raster output scanner that transmits a latent image from controller 22 onto the photoconductive surface of photoconductive belt 14. Controller 22 gets the image from raster input scanner 24 that typically incorporates a CCD and scans an image from document handler 26. Alternately, controller 22 gets the image from a separate computer 28 when printing section 3 operates as a printing device. Photoconductive belt 14 then advances to development station 30 where toner is electrostatically attracted to the latent image. Photoconductive belt 14 then advances to image transfer station 32. A sheet of material 34 is advanced from sheet stack 38 or sheet stack 40 by a sheet transport system 36 that includes registration system 42 that registers sheet 34 and then advances sheet 34 past image transfer station 32 in a timed fashion. The toner deposited on the latent image of photoconductive belt 14 is transferred to sheet 34 due to sheet 34 becoming charged at image transfer station 32 and due to sheet 34 being registered or timed relative to the latent image. Sheet 34 is then advanced to fusing station 44 by belt 46 where the toner image is permanently affixed to sheet 34, typically by heating, thus creating a document sheet. Sheet 34 will either be output to a finisher or a stacker by sheet feeder 50 or inverted at inverter 48 and recirculated through the printing section to have a second image deposited on its opposite side. Although the section 3 of the apparatus 2 has been described in detail above, features of the present invention could be used with other types of xerographic processing or printing sections having any suitably blank paper or sheet supply, created document output, image transfer system or paper path. The description above is merely intended to be exemplary. More or less features could also be provided. Although sheet feeder 50 is shown at a fixed position within the copying or printing apparatus, this position is intended to be exemplary and various alternative locations and modifications can be devised by those skilled in the art without departing from the invention. Such an alternative, for example, would be incorporating sheet feeder 50 at any point in the paper path of a copying or printing apparatus where the paper path is either upstream or downstream of the printing or copying operation. Such an alternative, for example, would be incorporating sheet feeder 50 in a finishing section or output section of a printing apparatus. An additional alternative, for example, would be incorporating belts instead of rollers within sheet feeder 50.

Figure 3:
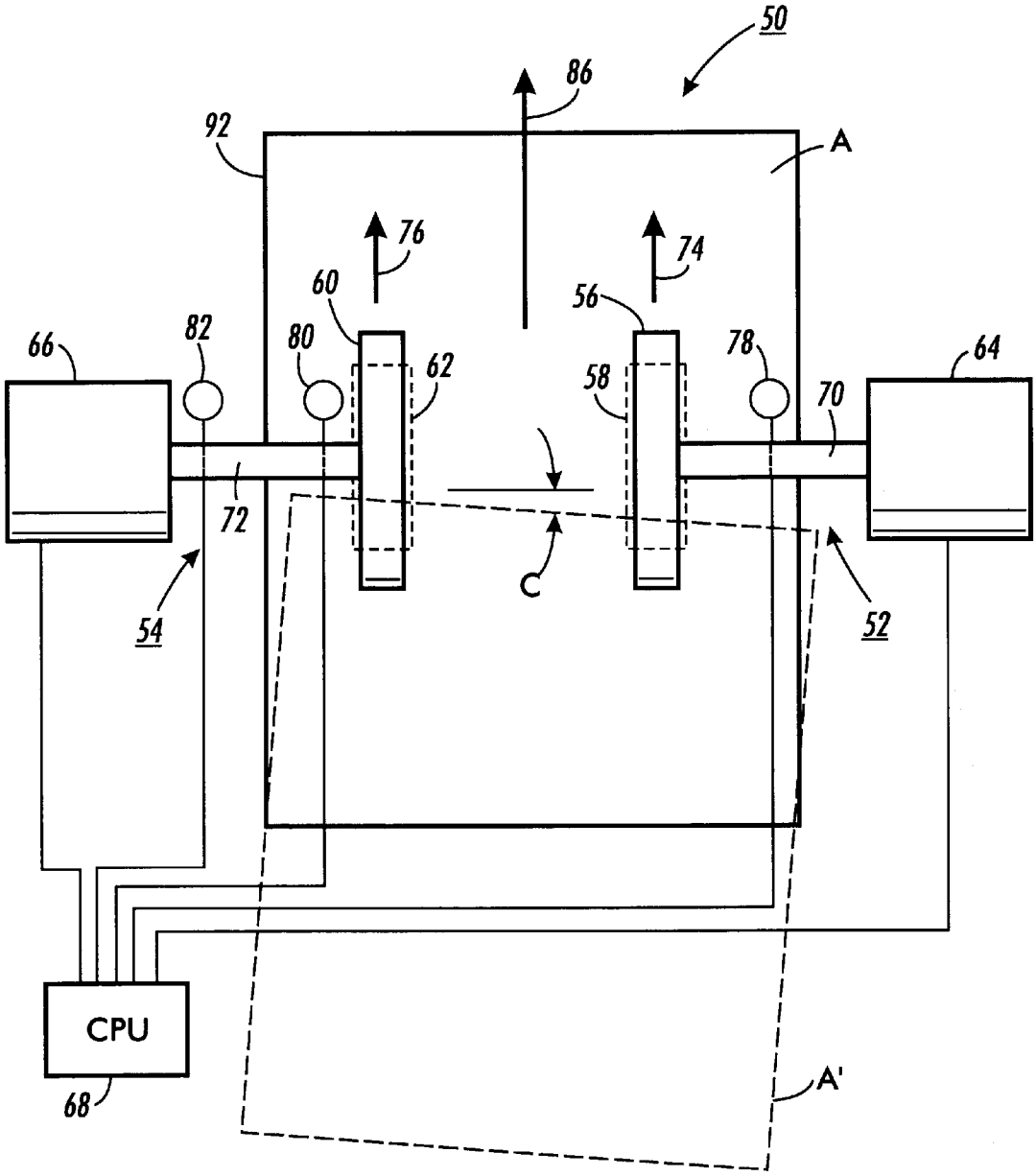
FIG. 3 is a schematic plan view of the sheet feeder according to the present invention.

Referring now also to FIG. 3, there is shown a schematic plan view of the sheet feeder 50 incorporating features of the present invention. Sheet feeder 50 includes the first drive 52 and the second drive 54. First drive 52 and second drive 54 are shown on a common centerline but may alternately have offset centerlines from each other. First drive 52 has a first drive roll 56 and a first idler roll 58 located below drive roll 56. Second drive 54 has a second drive roll 60 and a second idler roll 62 located below drive roll 60. In each instance, the idler and drive rolls are urged against each other to allow sheets to be moved by frictional engagement between them. First drive roll 56 is driven by first motor 64. Second drive roll 60 is driven by second motor 66. Controller 68 is connected to first motor 64 and second motor 66. Controller 68 is shown as a single controller, but may alternately be individual controllers, or logic circuits or part of an overall machine controller. First motor 64 may be directly connected to first drive roll 56 with shaft 70 or may be connected to additional drives or drive rolls in addition to first drive roll 56. Through first motor 64, controller 68 can vary first drive velocity 74 imparted to sheet of material A by first drive roller 56 either by varying the velocity of first motor 64, by mechanical speed reduction as with gearing, belt or a clutch, or otherwise. Second motor 66 may be directly connected to second drive roll 60 with shaft 72 or may be connected to additional drives or drive rolls in addition to second drive roll 60. Through second motor 66, controller 68 can vary second drive velocity 76 imparted to sheet of material A by second drive roller 60 either by varying the velocity of second motor 66, by mechanical speed reduction as with gearing, belt or a clutch, or otherwise. Sheet feeder 50 further comprises a first sheet sensor 78, second sheet sensor 80 and third sheet sensor 82. First sheet sensor 78, second sheet sensor 80 and third sheet sensor 82 are connected to controller 68. The sensors 78, 80 and 82 could be any type of suitable sensor, such as an optical sensor for example. The sensors 78, 80 and 82 are shown offset from shafts 70 and 72, but may alternately be on the same centerline or further upstream or downstream of shafts 70 and 72. The sensors 78, 80 and 82 are shown in line with each other, but may alternately be on the different centerlines further upstream or downstream. Sensors 78, 80 and 82 detect when an edge of sheet of material A passes and sends a signal to controller 72. As the sheet of material A enters the sheet feeder, it is contacted by the two rolls 56, 58 of the first drive 52 and by the two rolls 60, 62 of the second drive 54. Sheet of material A is advanced by the first drive 52 and the second drive 54 in a direction nominally parallel to the paper path 86 which is perpendicular to shafts 70 and 72. Sheet of material A will continue to be advanced in a direction nominally parallel to the paper path 86 if first drive velocity 74 and second drive velocity 76 remain equal.

In the embodiment shown, first sensor 78 and second sensor 80 are positioned to determine the skew angle of sheet of material A when it passes through first drive 52 and second drive 54. As sheet of material A enters first drive 52 and second drive 54 as shown in phantom as position A', it is moving along the paper path 86 with a skew angle C measured from its leading edge 90 to a line perpendicular to paper path 86. Phantom position A' shows skew angle C to be initially in the clockwise direction, but it could be in a counterclockwise direction or straight (i.e.: C has zero degree angle). Controller 68 determines the skew angle C as a function of the velocity of sheet of material A and the time difference between when sheet of material A passes over first sensor 78 and second sensor 80. Knowing the initial value of skew angle C, controller 68 can vary first drive velocity 74 and second drive velocity 76 to adjust skew angle C of leading edge 90 of sheet of material A to a desired value. Once a desired value for skew angle C is obtained, controller 68 can vary first drive velocity 74 and second drive velocity 76 such that they are equal and sheet of material A will then continue to be advanced in a direction nominally parallel to the paper path 86. In the embodiment shown, second sensor 80 and third sensor 82 are positioned on opposite sides of the nominal location of the lateral side 92 of a sheet of material moving along paper path 86. As a result, there is provided a sheet feeding system that provides capability to both deskew and offset sheets of material without the cost and complexity associated with a laterally movable tray being required in a sheet stacker.

Figure 4A:
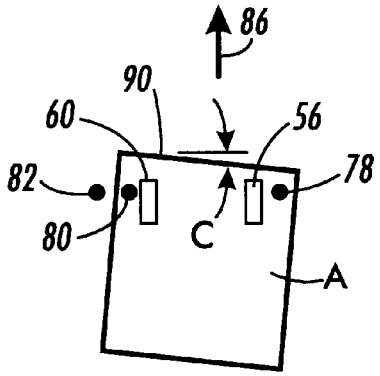
FIG. 4A is a schematic plan view showing a sheet of material being driven by the sheet feeder according to the present invention after the initial skew angle of the sheet has been determined.
Figure 4B:
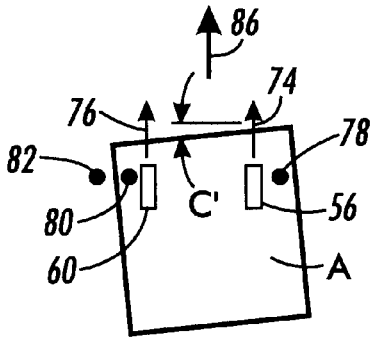
FIG. 4B is a schematic plan view showing a sheet of material being driven by the sheet feeder according to the present invention after the skew angle of the sheet has been adjusted for right stacking.
Figure 4C:
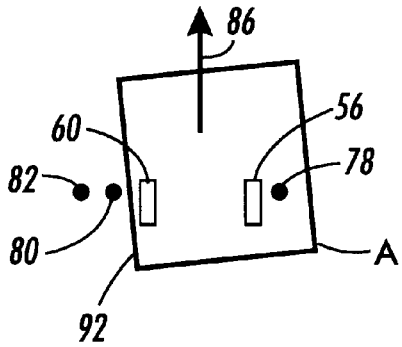
FIG. 4C is a schematic plan view showing a sheet of material being driven by the sheet feeder according to the present invention after the edge of the sheet has been detected for right stacking.
Figure 4D:
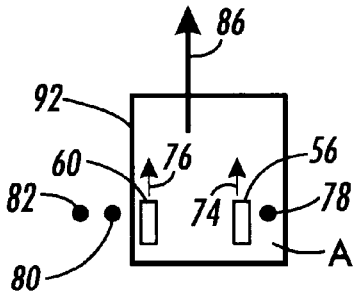
FIG. 4D is a schematic plan view showing a sheet of material being driven by the sheet feeder according to the present invention after the sheet has been deskewed and offset for right stacking.

Referring now to FIGS. 4A through 4D, there is shown a sheet feeding sequence where sheet of material A is offset a nominally fixed distance to the right of paper path 86. FIG. 4A is a schematic plan view showing sheet of material A being driven by first drive roll 56 and second drive roll 60 after the initial skew angle C of lead edge 90 of sheet of material A has been determined from first sensor 78 and second sensor 80 as described above. FIG. 4B is a schematic plan view showing sheet of material A being driven by first drive roll 56 and second drive roll 60 after the skew angle of the sheet has been adjusted to skew angle C' that is counterclockwise relative to paper path 86. In the instance shown, where sheet of material A needed to rotate counterclockwise, this is accomplished with controller 68 varying first drive velocity 74 and second drive velocity 76 for a period of time such that first drive velocity 74 is greater relative to second drive velocity 76 until the desired skew angle C' is being approached or is obtained. Once the desired skew angle C' is being approached or is obtained, controller 68 can vary first drive velocity 74 and second drive velocity 76 such that they are equal and sheet of material A will then continue to be advanced in a direction nominally parallel to the paper path 86. FIG. 4C is a schematic plan view showing a sheet of material A being driven by the first drive roll 56 and second drive roll 60 just after the lateral side 92 of sheet of material A has been detected by second sensor 80 and just before the deskewing maneuver. FIG. 4D is a schematic plan view showing sheet of material A being driven by the sheet feeder according to the present invention after the sheet has been deskewed and offset for right stacking. Sheet of material A is shown being driven by first drive roll 56 and second drive roll 60 after the skew angle of the lead edge 90 of sheet of material A has been adjusted to be perpendicular relative to paper path 86. This is accomplished with controller 68 varying first drive velocity 74 and second drive velocity 76 for a period of time such that second drive velocity 76 is greater relative to first drive velocity 74 until the desired skew angle perpendicular to paper path 86 is being approached or is obtained. Once the desired skew angle is being approached or is obtained, controller 68 can vary first drive velocity 74 and second drive velocity 76 such that they are equal and sheet of material A will then continue to be advanced in a direction nominally parallel to the paper path 86 where lead edge 90 of sheet of material A is perpendicular relative to paper path 86. In this manner, sheet of material A has been deskewed such that leading edge 90 is perpendicular to paper path 86 and lateral side 92 is offset to the right a nominally fixed distance relative to paper path 86 before sheet of material A completes contact with first drive roll 56 and second drive roll 60.

Figure 5A:
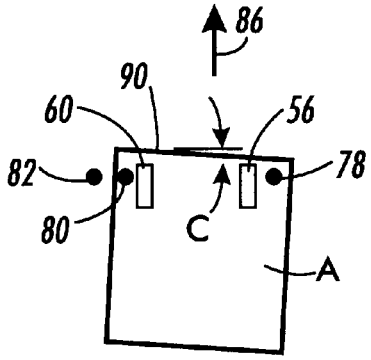
FIG. 5A is a schematic plan view showing a sheet of material being driven by the sheet feeder according to the present invention after the initial skew angle of the sheet has been determined.
Figure 5B:
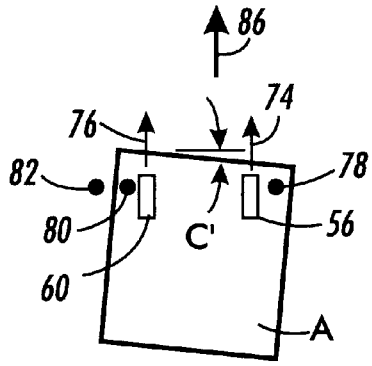
FIG. 5B is a schematic plan view showing a sheet of material being driven by the sheet feeder according to the present invention after the skew angle of the sheet has been adjusted for left stacking.
Figure 5C:
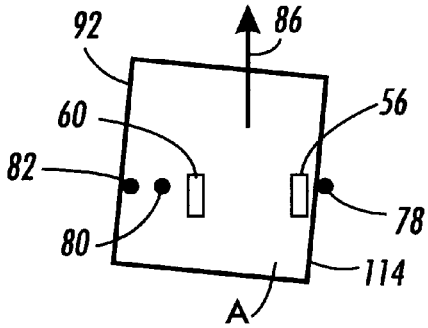
FIG. 5C is a schematic plan view showing a sheet of material being driven by the sheet feeder according to the present invention after the edge of the sheet has been detected for left stacking.
Figure 5D:
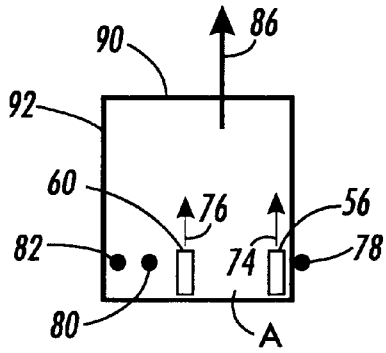
FIG. 5D is a schematic plan view showing a sheet of material being driven by the sheet feeder according to the present invention after the sheet has been deskewed and offset for left stacking.

Referring now to FIGS. 5A through 5D, there is shown a sheet feeding sequence where sheet of material A is offset a nominally fixed distance to the left of paper path 86. FIG. 5A is a schematic plan view showing sheet of material A being driven by first drive roll 56 and second drive roll 60 after the initial skew angle C of lead edge 90 of sheet of material A has been determined from first sensor 78 and second sensor 80 as described above. FIG. 5B is a schematic plan view showing sheet of material A being driven by first drive roll 56 and second drive roll 60 after the skew angle of the sheet has been adjusted to skew angle C' that is clockwise relative to paper path 86. In the instance shown where sheet of material A needed to rotate clockwise, this is accomplished with controller 68 varying first drive velocity 74 and second drive velocity 76 for a period of time such that second drive velocity 76 is greater relative to first drive velocity 74 until the desired skew angle C' is being approached or is obtained. Once the desired skew angle C' is being approached or is obtained, controller 68 can vary first drive velocity 74 and second drive velocity 76 such that they are equal and sheet of material A will then continue to be advanced in a direction nominally parallel to the paper path 86. FIG. 5C is a schematic plan view showing a sheet of material A being driven by the first drive roll 56 and second drive roll 60 just after the lateral side 92 of sheet of material A has been detected by third sensor 82 and just before the deskewing maneuver. Note that, as shown in FIG. 5C, first sensor 78 can similarly be used to detect lateral side 114 to trigger the deskewing maneuver for sheets that have the same width, thus eliminating the need for third sensor 82 in machines that are adapted to process sheets of material with a single width. FIG. 5D is a schematic plan view showing sheet of material A being driven by the sheet feeder according to the present invention after the sheet has been deskewed and offset for left stacking. Sheet of material A is shown being driven by first drive roll 56 and second drive roll 60 after the skew angle of the lead edge 90 of sheet of material A has been adjusted to be perpendicular relative to paper path 86. This is accomplished with controller 68 varying first drive velocity 74 and second drive velocity 76 for a period of time such that first drive velocity 74 is greater relative to second drive velocity 76 until the desired skew angle perpendicular to paper path 86 is being approached or is obtained. Once the desired skew angle is being approached or is obtained, controller 68 can vary first drive velocity 74 and second drive velocity 76 such that they are equal and sheet of material A will then continue to be advanced in a direction nominally parallel to the paper path 86 where lead edge 90 of sheet of material A is perpendicular relative to paper path 86. In this manner, sheet of material has been deskewed such that leading edge 90 is perpendicular to paper path 86 and lateral side 92 is offset to the left a nominally fixed distance relative to paper path 86 before sheet of material A completes contact with first drive roll 56 and second drive roll 60. As a result, there is provided a sheet feeding system that provides capability to both deskew and offset sheets of material without the cost and complexity associated with a laterally movable tray being required in a sheet stacker.

Figure 6:
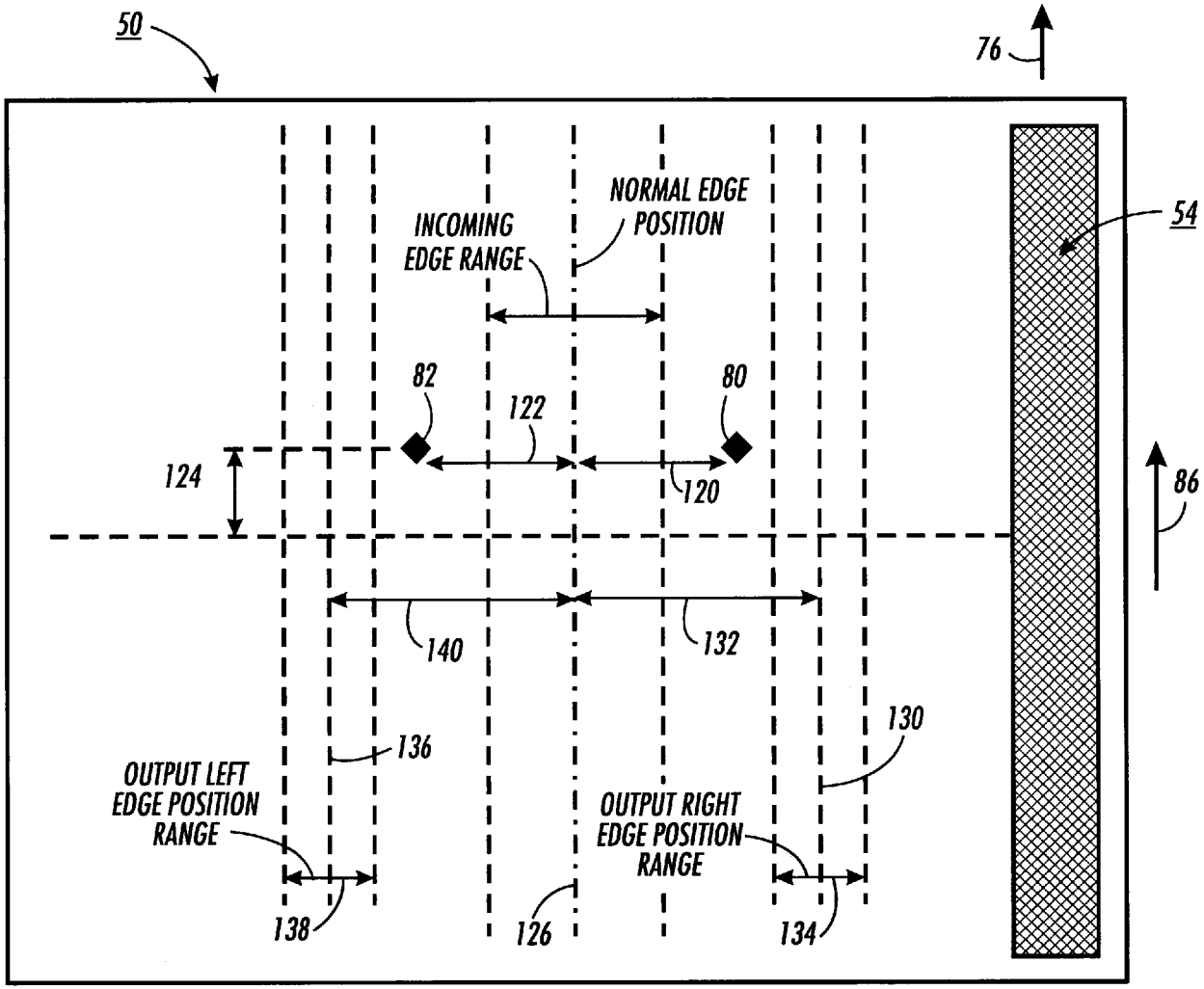
FIG. 6 is a schematic plan view showing the second and third sensor placement.

Referring now also to FIG. 6, there is shown a schematic plan view showing the second sensor 80 and third sensor 82 placement for sheet feeder 50 incorporating features of the present invention. Sheet feeder 50 includes second drive 54 as herein described. Second drive 54 can vary second drive velocity 76. Sheet feeder 50 further comprises second sheet sensor 80 and third sheet sensor 82 as herein described. Sensors 80 and 82 detect when the edge of sheet of material A passes. In the embodiment shown, second sensor 80 and third sensor 82 are positioned on opposite sides of the nominal edge position 126 of the lateral side of sheets of material moving along paper path 86. Sensor 80 is located a distance 120 from nominal edge position 126 and a distance 124 from the centerline of second drive 54. Distance 124 may be 3 millimeters. Distance 120 may be 5.5 mm. In and alternate embodiment, distances 120 and 124 may be greater or smaller or otherwise different. Sensor 82 is located a distance 122 from nominal edge position 126 and a distance 124 from the centerline of second drive 54. Distance 124 may be 3 millimeters. Distance 122 may be 5.5 mm. In and alternate embodiment, distances 122 and 124 may be more or less or otherwise different. The system may offset and deskew sheets of material that are driven with an incoming lateral edge position range 128. Incoming lateral edge position range 128 may be 6 millimeters (+/−3 millimeters). In alternate embodiments, incoming lateral edge position range 128 may be greater or smaller. The system may offset and deskew sheets of material with an output left edge position 136 located distance 140 from nominal edge position 126. Distance 140 may be 8.5 millimeters. In an alternate embodiment, distance 140 may be greater or smaller. The system may offset and deskew sheets of material with an output left edge position range 138. Output left edge position range 138 may be 3 millimeters (+/−1.5 millimeters). In an alternate embodiment, output left edge position range 138 may be more or less. The system may offset and deskew sheets of material with an output right edge position 130 located distance 132 from nominal edge position 126. Distance 132 may be 8.5 millimeters. In an alternate embodiment, distance 132 may be greater or smaller. The system may offset and deskew sheets of material with an output right edge position range 134. Output right edge position range 134 may be 3 millimeters (+/−1.5 millimeters). In an alternate embodiment, output right edge position range 134 may be more or less. In this manner, documents may be offset either left or right and easily identified by the user.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A sheet feeder comprising:

at least two drives adapted to drive a sheet of material along a paper path;

at least two sensors proximate the drives adapted to detect opposite lateral sides of the sheet of material; and a controller connected to the two sensors and at least one of the drives;

wherein, the controller varies a drive speed of at least one of the drives to shift a lateral position of the sheet of material in a predetermined direction until one of the sensors detects one of the lateral sides.

2. The sheet feeder of claim 1, wherein before contact ends between the sheet of material and at least one of the drives, the controller varies the drive speed to position a lead edge of the sheet of material substantially perpendicular to the paper path.

3. A document creating apparatus comprising an image transfer system for transferring an image onto a sheet of material coupled to the sheet feeder of claim 1.

4. The sheet feeder of claim 1 wherein the sensors are optical sensors.

5. The sheet feeder of claim 1 wherein the two drives comprise:

a first drive comprising a first idler roll and a first drive roll; and a second drive positioned next to the first drive comprising a second idler roll and a second drive roll.

6. The sheet feeder of claim 1 wherein, the controller varies the drive speed of the at least two of the drives to shift the lateral position of the sheet of material in a predetermined direction until one of the sensors detects one of the opposite lateral sides.

7. A sheet feeder comprising:

a drive adapted to drive a sheet of material along a paper path;

at least three sensors proximate the drive, wherein two of the sensors are adapted to detect a skew of the sheet of material, and wherein another two of the sensors are located to detect opposing edges of the sheet of material for detecting a lateral offset of the sheet of material from the paper path; and a controller connected to the sensors and the drive.

8. The sheet feeder of claim 7, wherein after the skew is detected, the drive and controller are adapted to shift the skew to a predetermined value.

9. The sheet feeder of claim 8, wherein before contact ends between the sheet of material and the drive, a lead edge of the sheet of material is positioned substantially perpendicular to the paper path.

10. The sheet feeder of claim 7, wherein before contact ends between the sheet of material and the drive, a lead edge of the sheet of material is positioned substantially perpendicular to the paper path.

11. A document creating apparatus comprising an image transfer system for transferring an image onto a sheet of material coupled to the sheet feeder of claim 7.

12. The sheet feeder of claim 7 wherein the sensors are optical sensors.

13. The sheet feeder of claim 7 wherein the drive comprises:

a first drive comprising a first idler roll and a first drive roll; and a second drive positioned next to the first drive comprising a second idler roll and a second drive roll.

14. The sheet feeder of claim 7 wherein, the controller is adapted to vary a first drive speed of the first drive and a second drive speed of the second drive to shift the lateral position of the sheet of material in a predetermined direction until one of the sensors detects a lateral side of the sheet.

* * * * *